US007051963B1

(12) United States Patent
Buckley

(10) Patent No.: US 7,051,963 B1
(45) Date of Patent: May 30, 2006

(54) PILL CRUSHER POUCH AND METHOD OF USING SAME

(75) Inventor: Thomas L. Buckley, Laguna Niguel, CA (US)

(73) Assignee: Links Medical Products, Inc., Irvine, CA (US)

( * ) Notice: Subject to any disclaimer, the term of this patent is extended or adjusted under 35 U.S.C. 154(b) by 204 days.

(21) Appl. No.: 10/690,248

(22) Filed: Oct. 21, 2003

(51) Int. Cl.
*B02C 19/00* (2006.01)

(52) U.S. Cl. ..... 241/169; 241/DIG. 17

(58) Field of Classification Search ..... 241/168, 241/169, DIG. 27, 301; D9/703; 206/219, 206/363; 383/107, 121–124, 109, 906
See application file for complete search history.

(56) References Cited

U.S. PATENT DOCUMENTS 3,618,751 A * 11/1971 Rich ..... 206/219
4,366,930 A 1/1983 Frombetti, Jr.
5,059,036 A * 10/1991 Richison et al. ..... 383/61.2
5,531,386 A 7/1996 Jensen
5,618,004 A 4/1997 Klearman et al.
5,823,451 A 10/1998 Sharpe
5,863,001 A 1/1999 Schulze
5,915,637 A 6/1999 Parsons
6,059,209 A 5/2000 Barson
6,076,664 A * 6/2000 Yeager ..... 206/217
2005/0078888 A1* 4/2005 Taheri ..... 383/107

* cited by examiner

*Primary Examiner*—Mark Rosenbaum
(74) *Attorney, Agent, or Firm*—Jerry R. Potts

(57) ABSTRACT

A pill crusher pouch, dimensioned to be received between a platen and anvil of a pill crusher wherein the anvil is integrally fixed to a base and wherein the platen is coupled to said base through a moveable handle, is constructed a seamless tube of flexible material having an open top and a closed bottom, wherein the closed bottom is formed a cup like seal that provides the pouch with a comerless interior that facilitates easy pouring of pulverized material from the interior of the pouch.

13 Claims, 3 Drawing Sheets

PILL CRUSHER POUCH AND METHOD OF USING SAME

RELATED PATENT APPLICATIONS

This application is related to U.S. Design patent application Ser. No.: 29/192265, entitled "Pill Crusher Pouch," filed concurrently herewith, now U.S. Pat. No. Des. 497,543.

BACKGROUND OF THE INVENTION

The present invention relates generally to patient care devices and, more particularly, to pouches for pill crushing devices.

Modern medicines come in a variety of forms and commonly the form is that of a pill. This can be defined generally as a small, usually soluble medicated mass that is shaped to facilitate swallowing. Typically, it contains a filler and an excipient substance that facilitates working it into the desired pillular form. One skilled in the art of patient medication may distinguish between a "pill" and a "tablet" but, as the term is used herein, "pill" is intended to include both. Typically, pills come in a variety of sizes and shapes, and, because of the manufacturing process, often have a hard outer shell.

In some cases, to accomplish efficient patient medication, it is advisable to crush the pill rather than having the patient consume it whole. For example, if a patient has difficulty in swallowing, it can be helpful to pulverize the pill and combine the fragments with a carrier, such as a fruit juice. Because of this recognized need, various pill-crushing devises are known.

Since pill-crushing devices are used in a patient care setting, it is important that they be reliable, quiet in operation and readily usable by care giving personnel, and most importantly that they provide a vehicle for assuring that the patient receives the full dosage of a prescribed medication.

While many pill-crushing devices, such as the pill-crushing device described in U.S. Pat. No. 5,915,637, have mete with commerical success, the pill crusher pouch has been less than satisfactory. In this regard, there is a need for a new and improved pill crusher pouch that allows substantially the whole of a crushed pill to be easily extracted and consumed by a patient.

DISCLOSURE OF THE INVENTION

Disclosed herein is a pill crusher that relies on pressure not impact force to crush pills. A removable or replaceable pouch dispenser is disposed on board for the storage of a plurality of pouches, which are dimensioned for receiving one or a plurality of pills. In the preferred embodiment of the present invention each pill pouch is dimensioned to fit in a mouth defined by an anvil and a platen of the pill crusher. The pouch is comprised of a single sheet of transparent flexible sheet material having a right side edge, a left side edge, a top edge and a bottom edge. The sheet of material is folded laterally to bring the right side edge and the left side edge into alignment to form a common side edge. The common side edge is heat sealed to close and form an open container having a front panel and a back panel. Another heat seal is applied to a bottom portion of the container which seals a bottom portion of the front panel and a bottom portion of the back panel together and further creates a smooth rounded or curved base line within the container that substantially prevents any crushed pill residue from being trapped at the bottom comers of the container and therefore waste.

The preferred embodiment of the invention affords several advantages. By eliminating the sharp pouch corners the pouch allows substantially the full dose of the crushed pill to be extracted from the pouch and to be consumed by the user. Further by dimension, a plurality of the pouches can be stored in a replaceable pouch dispenser that slides conveniently into a conventional pill crusher that relies on pressure, not impact forces, to accomplish pill crushing.

Other aspects and advantages of the present invention will become apparent from the following detailed description, taken in conjunction with the accompanying drawings, illustrating by way of example the principles of the invention.

BEST MODE FOR CARRYING OUT THE INVENTION

The present invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes which come within the meaning and range of equivalency of the claims are to be embraced within their scope.

Figure 7:
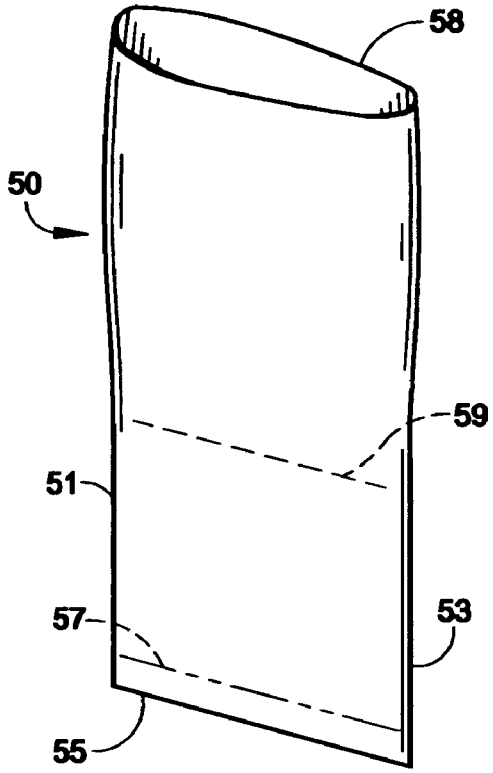
FIG. 7 (PRIOR ART)
FIG. 7 is a front elevational view of a prior art pill crusher pouch for use with the pill crusher of FIG. 1.

Before describing the new and improved pill crusher pouch construction, it may be beneficial to first describe a prior art pill crusher pouch and its associated pill crusher 10. In this regard, a prior art pouch 50 is illustrated in FIG. 7.

Figure 4:
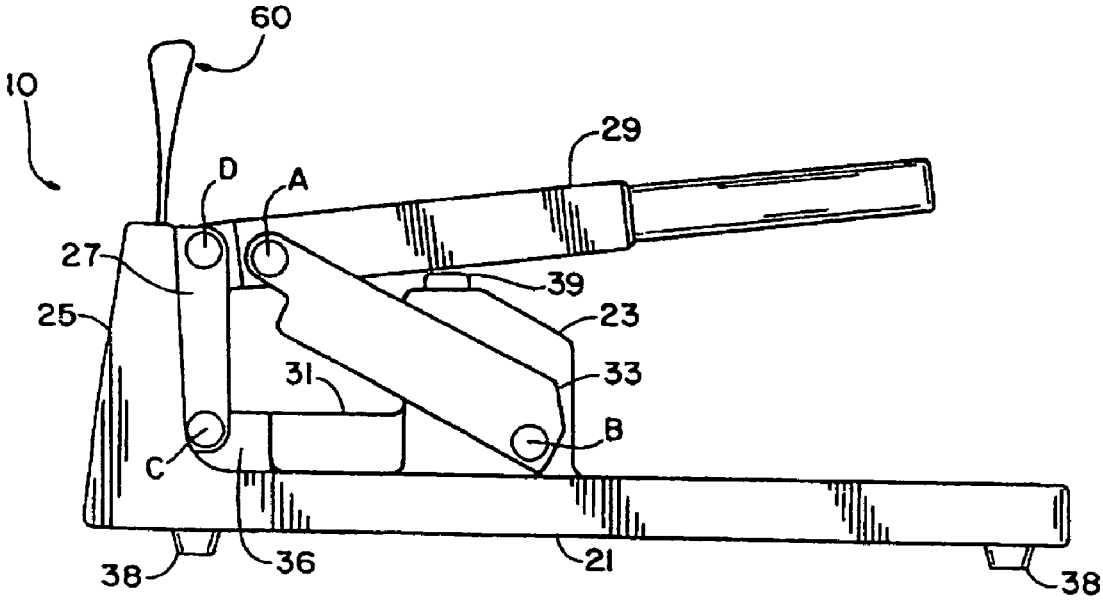
FIG. 4 is a side elevational view of the pill crusher of FIG. 1, showing the housing removed and the handle in a pill crushing position.

The pouch 50 is formed from a single sheet of transparent flexible sheet material such as polyethylene. The sheet is formed into a tube like configuration to provide pouch sides, such as the side 51, and the side 53. A heat seal is applied to a bottom portion 55 of the material to seal it front and back portions together and to form a seal line indicated generally at 57 to provide a leak tight container. The aforementioned panels are unsealed at their tops and an opening 58 is, thus presented. Indicia such as the indicia 59 are stamped or printed on the pouch 50 and the indicia can be helpful in orienting the pouch within the pill crusher 10 (FIG. 4). As can be readily seen in FIG. 7, when the heat seal is applied to the bottom portion 55 of the material, the seal line 57 forms sharp 90-degree angles at the right side edge 51 and the left side edge 53 of the pouch 50. These sharp 90-degree angles therefore create interior comers that trap and prevent finely pulverized pill material from escaping from the interior of the pouch 50.

Figure 1:
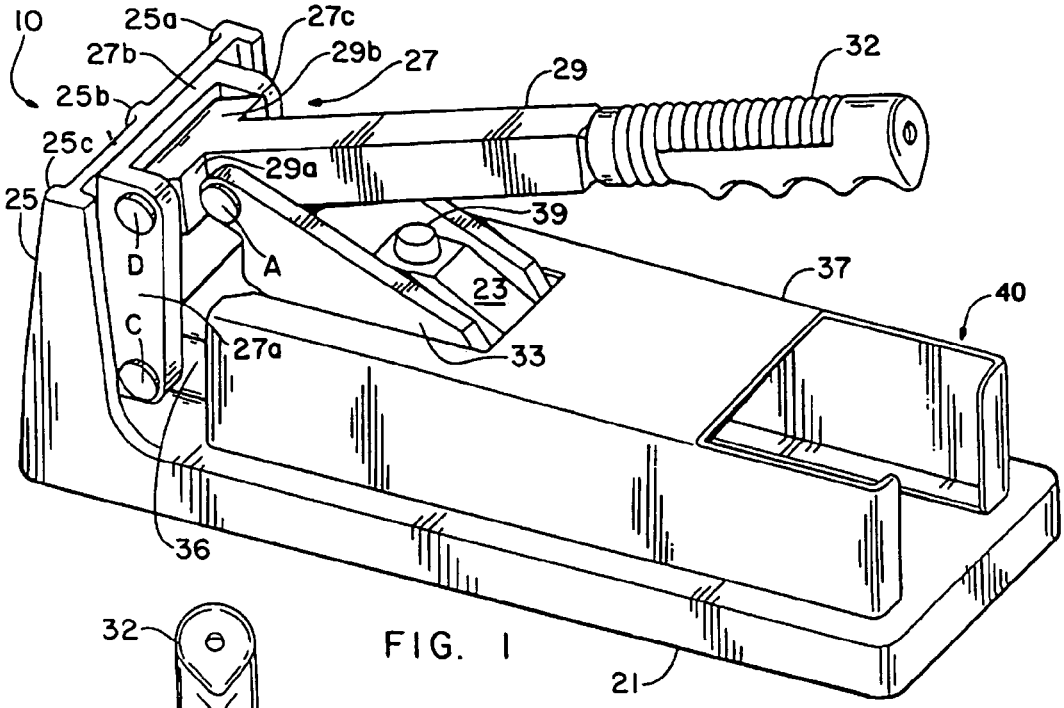
FIG. 1 is a perspective view of a pill crusher of the present invention.
Figure 2:
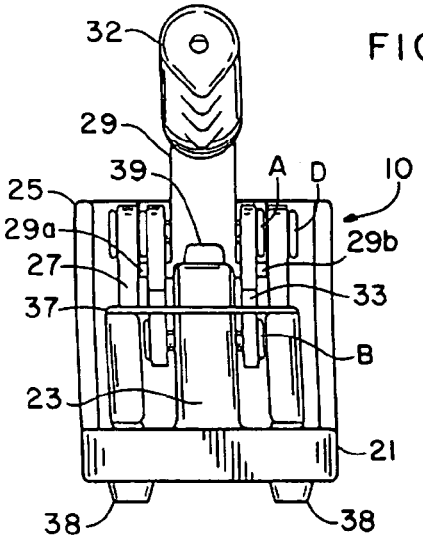
FIG. 2 is a rear elevational view of the pill crusher of FIG. 1.

Referring now to the drawings and more particularly to FIG. 1 thereof, there is illustrated the pill crusher 10 which is utilized with a new and improved pill crusher pouch 60, which is constructed according to a preferred embodiment of the present invention. The pill crusher 10 includes an elongated, generally rectangular base 21 from which an integrally formed anvil 25 projects upwardly. A forward anchor block 36 is integrally formed at the upper surface of the base 21 and a platen 27 is pivotally connected thereto by a pin or pivot C, for rotational movement of the platen 27 against the anvil 25. A handle 29 is pivotally connected to the platen 27, at an upper end thereof, by a pin or pivot D.

A rear anchor block 23, integrally formed with the base 21, is located rearward of the forward anchor block 36. A compression linkage 33 is pivotally connected to the block 23 by a pin or pivot B and, in addition, the linkage 33 is pivotally connected to the handle 29 by a pin or pivot A A strengthening rib 31, integrally formed with the base 21, the forward anchor block 36, and the rear anchor block 23, helps to limit distortion of the base 21 during operation of the pill crusher 10. A housing 37 covers a substantial portion of the base 21 and is attached thereto, in a conventional manner, at the upper surface thereof. The cover 37 is opened rearwardly to afford access to a storage and dispensing area 38 for a plurality of pouches, exemplary of which is the pouch 60 shown in FIG. 6.

A shock-absorbing bumper 39 is affixed to the top of the rear anchor block 23 for cushioning downward movement of the handle 29 during operation of the pill crusher 10. In this regard, the bumper 39 helps to ensure quiet operation of the pill crusher. The handle 29 has a resilient rubber-like grip 32 to facilitate easy handling thereof. A plurality of legs 38 support the base 21 and support it above a table or counter surface for ease of operation.

Some other components of the pill crusher 10 will now be considered in greater detail. It is apparent to one skilled in the art that the device utilizes a compound lever to move the platen 27 and, as a result, great forces are brought to bear against the anvil 25. To enable the anvil 25 to withstand such forces, ribs 25*a*, 25*b* and 25*c* are integrally formed with the anvil 25 to strengthen it. The platen 27 also sustains great loads and it is strengthened by wings 27*a* and 27*b*, each of which flanks a plate 27*b*. It will be noted, with reference to FIG. 1, that the combined width of the plate 27*b* and the pair of wings 27*a* and 27*c* provides a platen which fits between the anvil ribs 25*a* and 25*c* to ensure a substantially enclosed mouth 41 for the pill crushing process.

Since the crushing process is efficiently accomplished when the platen 27 is driven directly forward, wings 29*a* and 29*b*, integrally formed in the handle 29, cooperate with the platen wings 27*a* and 27*c* to constrain lateral movement of the platen 27.

Figure 1A:
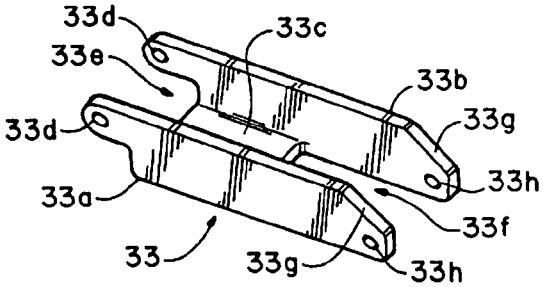
FIG. 1A is an illustrative view of a compression linkage of the pill crusher of FIG. 1.
Figure 3:
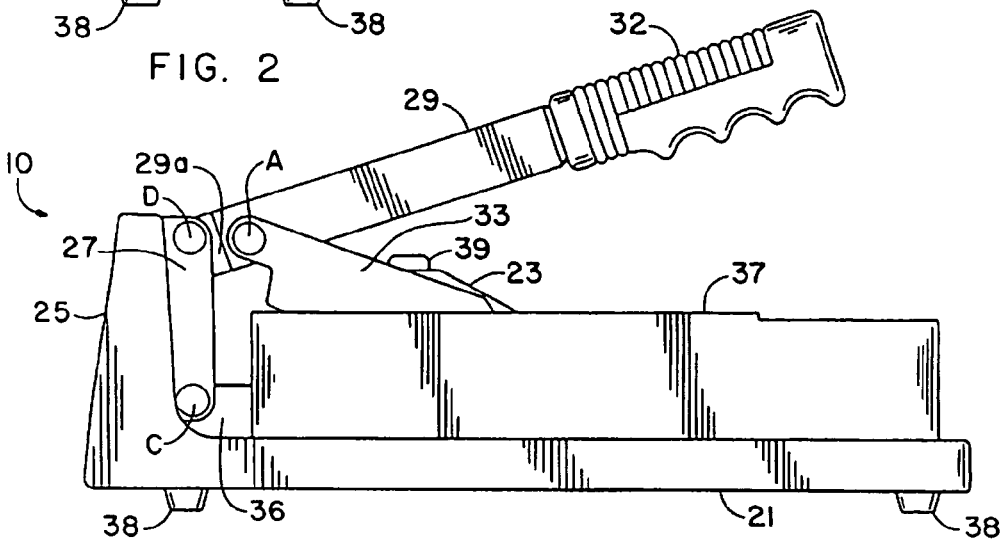
FIG. 3 is a side elevational view of the pill crusher of FIG. 1.

Considering now the compression linkage 33, with reference to FIG. 1A, the linkage is generally channel shaped, having a bottom wall 33*c* and integrally connected side walls 33*a* and 33*b*. The side walls have openings 33*d* formed in the forward portions thereof for receipt therethrough of the pivot A. Similarly, openings 33*h*, formed in the rearward portions of the side walls 33*a* and 33*b* are adapted for receipt of the pivot B. A cutaway opening 33*e* is formed in the forward portion of the linkage 33 and another cutaway opening 33*f* is formed in the rearward portion of the linkage 33. The openings 33*e* and 33*f* permit clearance of the linkage 33 between the platen 27 and the rear anchor block 23, respectively, during pill crusher 10 operation.

Figure 5:
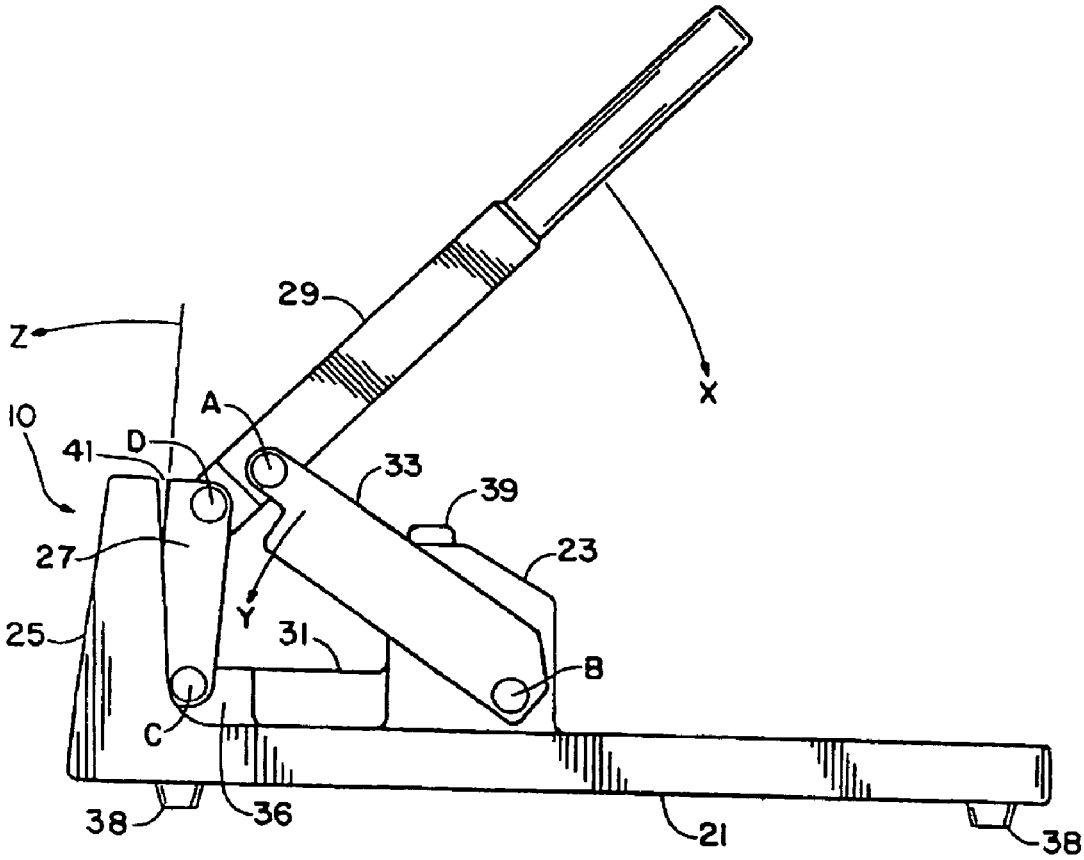
FIG. 5 is a side elevational view of the pill crusher of FIG. 1, showing the housing removed and the handle in a pill receiving position.

The operation of the pill crusher 10 will now be considered in greater detail in respect of a pill crushing process. During the pill crushing operation, the pins C and B act as fixed pivots, kept as they are within the respective front and rear anchor blocks 36 and 23, respectively, while the pivot A acts as a fulcrum pivot and the pivot D acts as a floating pivot. After a pouch 60, containing one or more pills, is placed in the mouth 41, the handle 29 is moved in a direction indicated by the letter X (FIG. 5). As the handle moves downwardly, a triangle formed by the legs AB, AD, and DB tends to collapse. Simultaneously, the compression linkage 33 begins to move in the direction indicated by the letter Y as the pivots D, A and B tend to move into alignment. Of course, true alignment is never achieved since the force which would be thereby realized would be excessive and would destroy the pill crusher 10 by fractured separation of the anvil 25 from the base 21. In order to prevent such an event, the anchor pivot B is fixed at a location short of an alignment position. In this manner, an efficient, powerful crushing action is achieved while destruction of the device 10 is avoided.

As the DAB triangle collapses, the action pivot D moves forwardly and the platen 27 rotates about the pivot C, as shown by the arrow Z (FIG. 5), to move against the anvil 25, thereby crushing any pill therebetween. It will be noted, with reference to FIG. 5, that the opening of the mouth 41 is greater at the top of the pill crusher 10 than it is nearer the pivot C. As a result, greater crushing forces come to bear the closer the pill is placed to the pivot C. As discussed more fully below, this characteristic can give the user of the pill crusher 10 flexibility in accomplishing the amount of pill crushing or pulverization desired.

Figure 6:
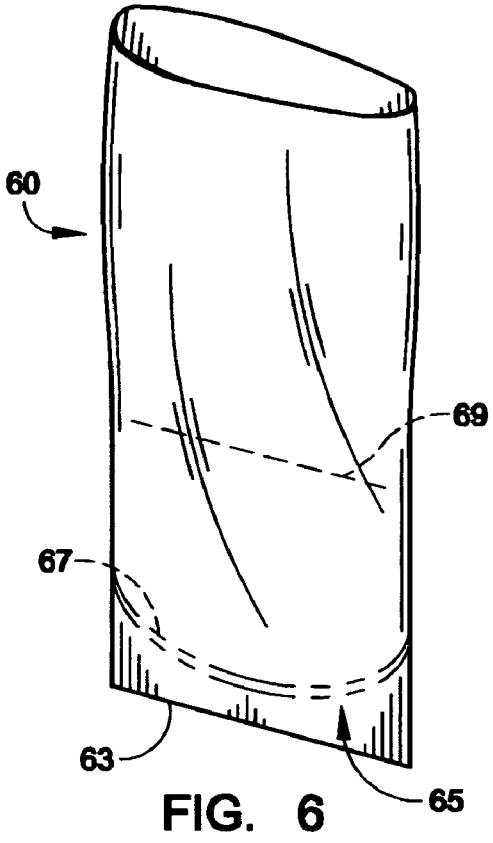
FIG. 6 is a front elevational view of a pill crusher pouch which is constructed in accordance with the present invention and which is adapted for use with the pill crusher of FIG. 1.

Considering further the pouch 60, as shown in FIG. 6, the pouch 60 is formed from a tubular sheet 62 of transparent flexible material such as polyethylene. In order to form the tubular sheet 62 into a closed container, a cup shaped heat seal, indicated generally at 65, is applied to a bottom portion 63 of the tubular sheet 62. By applying the cup shaped heat seal 65 to the bottom portion 63 of the tubular sheet 62, the interior of the pouch 60 is provided with a rounded or circular like cornerless bottom indicated generally at 67. This is an important feature of the preferred embodiment of the present invention as the rounded bottom is absent any sharp pointed comers that could otherwise easily trap and hold the finely pulverized or crushed pill material created when a pill is crushed within the pouch. In short then, with the rounded bottom, the user is able to extract from the interior of the pouch the whole of the pill that was crushed thereby assuring a full needed dosage can be easily extracted from the pouch 60 and taken by the patient. The configuration of the pouch 60 is particularly adapted for use with the pill crusher 10, having a width that conforms to the width of the mouth 41 of the pill crusher 10.

In operation, a pouch is removed from the pouch dispenser 38 and one or more pills are placed therein. It is recommended that the pouch 60 be not filled beyond the indicia 69, shown as a dotted line on the tubular sheet 62. Often, the pouch 60 will hold a plurality of pills, typically as many as five depending on the size thereof. The pouch 60 containing the pills can then be inserted into the mouth 41 and, depending upon the degree of crushing desired, the position of the pouch can vary within the mouth 41 wherein greater crushing forces are available the nearer the pouch 60 is to the pivot C. An advantage of the present invention is that the user can repeat the crushing operation, with the pouch 60 at a suitable level within the mouth 41, until the desired amount of pulverization is realized. In this regard, the transparent panels of the pouch 60 help the user determine whether additional crushing is needed.

As additional evidence of the flexibility of the pill crusher 10, the pouch 60 can be introduced from the top of the mouth 41 or it may be inserted between the anvil 25 and the platen 27 from a side, at the convenience of the user. After this choice is made, the user lifts the handle 29 to open the mouth 41 and inserts the loaded pouch 60. The handle 29 is then moved downwardly in the direction of the arrow X (FIG. 5) to pulverize the pills. It is sometimes helpful to move the pouch 60 up and down within the mouth 41 while during the crushing process in order to achieve a suitable degree of pulverization.

Advantageously, the use of the pouch 60 ensures that all of the medication intended for the patient is available and none of it is lost in transfer from a crucible into another container since the user can simply pour the pulverized pill particles from the pouch 60 into a suitable container. Still further, the on board dispenser 38 provides a clean and orderly place for pouch storage, readily at hand, for use during the pill crushing processing.

Thus, a clean and efficient technique of crushing pills is provided. In addition, because the dispenser is of an open design, the supply of pouches 50 can readily monitored and replenished as required.

The pill crusher 10 is composed, substantially, of non-corrosive metal. In a preferred embodiment, the pins or pivots A, B, C and D are of rolled steel composition, having a diameter of about ¼ inch to about ½ inch, with about ¼ inch being preferred.

It will be apparent from the above description of the pill crusher 10 that it affords several distinct advantages when compared to the prior art. In the first place, efficient and effective pill crushing can be readily achieved with little exertion on the part of the user. Attendant with this is the fact that the crushing operation is essentially noiseless so that the health provider can use the device 10 even in proximity to a sleeping patient, without fear of waking the patient. In addition, the use of the pouch 60 insures that trace medications are not left in the device 50 to contaminate medications subsequently introduced into the device. Thus, a measure of patient safety is realized.

With regard to the pouch 60, it is apparent that it represents an advance in the art. It is low in cost to produce and thus is disposable economically after one time use. This factor, in addition to the capability for segregating the medicines of individual patients, helps to reduce, if not eliminate, problems of medicinal cross contamination. Additionally, the pouch 60 can hold a plurality of pills so that the patient can receive a beneficial mix of medicines simultaneously. The pouch 60 is relatively long and narrow and it permits pill pulverizing to occur at a remote site with subsequent transportation to the patient without great concern of contamination of the pouch contents. Because it is transparent, the pouch 60 enables the user to determine readily when a desired level of pill pulverization has occurred. Finally, the pouch 60 can be sealed conventionally, by heat sealing for example, so that the process of pill pulverization can be accomplished at a convenient time for the care giver, with medicine administration occurring as needed, at a later time.

From the foregoing it will be appreciated that the pill crusher provided by the invention provides an efficient, relatively noiseless and safe technique for pulverizing pills in a patient care environment. The assembly is mechanically simple and reliable. It is compact and requires only a modest amount of counter space. In addition, the onboard dispenser provides convenient access to pouches, as the need arises.

Figure 8:
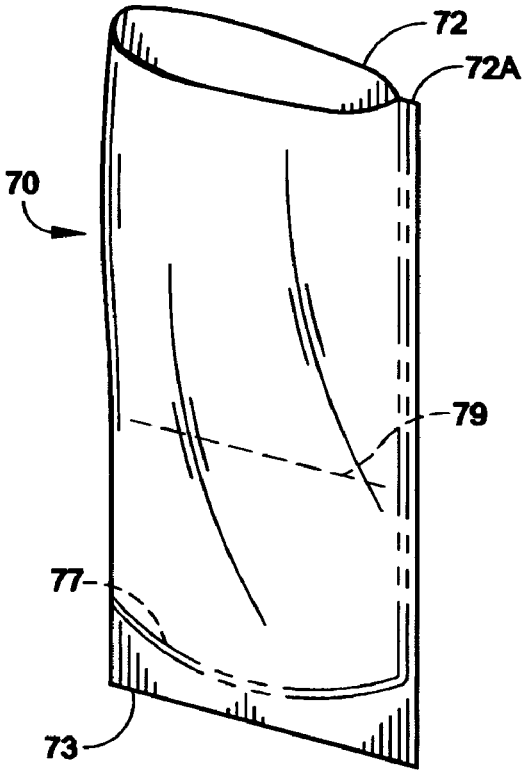
FIG. 8 is a front elevational view of another pill crusher pouch which is constructed in accordance with the present invention and which is adapted for use with the pill crusher of FIG. 1.

Referring now to the drawings and more particularly to FIG. 8, there is illustrated another pouch 70, which is constructed in accordance with the present invention. The pouch 70, it is formed from a single sheet 72 of transparent flexible sheet material, such as polyethylene, that has been cut into a generally rectangular shape. In order to form the pouch 70, the rectangular sheet 72 is folded, along an imaginary longitudinal line that divides the sheet into two equal halve, aligning its right side edge with its left side edge. A single heat seal 72A is applied over the aligned right side edge and left side edge of the folded sheet to form a generally tubular container having an open top and an open bottom. A curved cup like heat seal indicated generally at 77 is then applied to a bottom portion 73 of the container to provide it with a closed leak tight bottom. The configuration of the pouch 70 is particularly adapted for use with the pill crusher 10, having a width that conforms to the width of the mouth 41 of the pill crusher 10.

Figure 9:
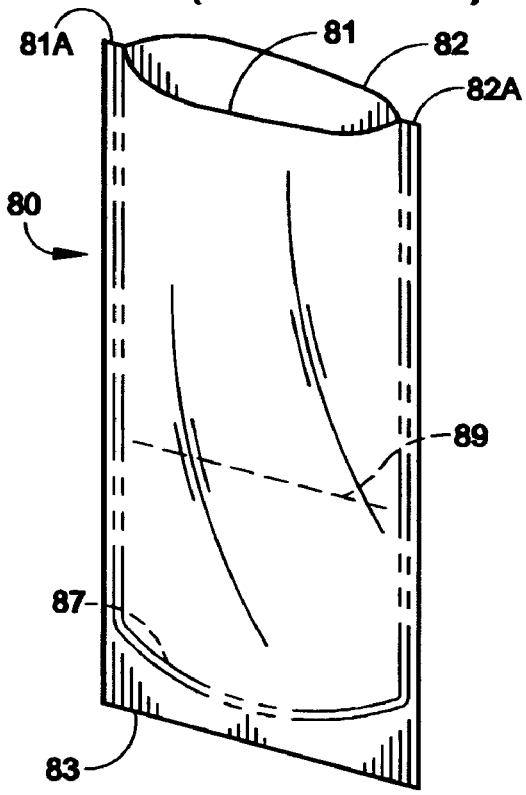
FIG. 9 is a front elevational view of still yet another pill crusher pouch which is constructed in accordance with the present invention and which is adapted for use with the pill crusher of FIG. 1.

Referring now to the drawings and more particularly to FIG. 9 thereof, there is illustrated another pill crusher pouch 80, which is constructed in accordance with the present invention. The pill crusher pouch 80 is formed from a pair of rectangularly shaped sheets, a front panel sheet indicated generally at 81 and a real panel sheet indicated generally at 82. The front panel sheet 81 and the real panel sheet 82 are each formed of a transparent flexible sheet material such as polyethylene.

In order to form the pouch 80, the two sheets 81 and 82 are first laid out in alignment on top of one another with their respective right side edges, left side edges, top edges and bottom edges in alignment. Next a left side heat seal 81A is applied to the left side edge portions of the sheets along their entire longitudinal dimension. Then a right side heat seal 82A is applied to the right side edge portions of the sheets along their entire longitudinal dimension. In this manner a container is formed having an open bottom and an open top. A curved cup like heat seal indicated generally at 87 is then applied to a bottom portion 83 of the container to provide it with a closed leak tight bottom. The aforementioned panels are unsealed at their tops and an opening 58 is, thus presented. Indicia such as the indicia 89 are stamped or printed on the pouch 80 and the indicia can be helpful in orienting the pouch within the pill crusher 10 (FIG. 4). The configuration of the pouch 80 is particularly adapted for use with the pill crusher 10, having a width that conforms to the width of the mouth 41 of the pill crusher 10.

It will be evident that there are additional embodiments and applications, which are not disclosed in the detailed description but which clearly fall within the scope of the present invention. The specification is, therefore, intended not to be limiting, and the scope of the invention is to be limited only by the following claims.

I claim:

1. A pill crusher pouch, comprising:

a single sheet of flexible sheet material folded upon itself and sealed along a longitudinal edge portion thereof to form an open pouch having a front panel and a back panel; and said front panel and said back panel being sealed together along a cup like seal line disposed at a base portion of said front panel and said back panel to provide said open pouch with a closed bottom and an open top; and said cup like seal line providing said open pouch with a cornerless smooth rounded interior bottom to facilitate easy pouring of pulverized pill residue from the interior of said open pouch.

2. The pill crusher pouch according to claim 1, wherein said single sheet of flexible material is transparent.

3. The pill crusher pouch according to claim 2, wherein said single sheet of flexible material is composed of polyethylene.

4. The pill crusher pouch according to claim 1, wherein said pouch is dimensioned to be received between a platen and anvil of a pill crusher; and wherein said anvil is integrally fixed to a base and wherein said platen is coupled to said base by moveable handle means having a handle.

5. The pill crusher pouch according to claim 4, further comprising means for moving forcibly said platen against said anvil when said moveable handle means is moved from a first position to a second position, said means for moving including a compression link fixed at a first pivot to said base and at a second pivot to said handle, wherein said second pivot functions as a fulcrum during handle movement.

6. The pill crusher pouch according to claim 1, wherein said single sheet of material includes marking indicia to provide an indication of maximum pill capacity for pill crushing purposes.

7. A pill crusher pouch, comprising a front rectangular panel of sheet material;

a back rectangular panel of sheet material;

a right side seal for securing a right side portion of said front panel of sheet material to a right side portion of said rear panel of sheet material;

a left side seal for securing a let side portion of said front panel of sheet material to a left side portion of said real panel of sheet material; and a cup-like seal for securing a bottom portion of said front panel of sheet material to a bottom portion of said rear panel of sheet material, said cup-like seal providing the pouch with a cornerless interior to facilitate easy pouring of pulverized material from the interior of the pouch.

8. The pill crusher pouch according to claim 7, wherein at least one of the rectangular sheets of material is a transparent sheet of material.

9. The pill crusher pouch according to claim 8, wherein the other one of the rectangular sheets of material is a transparent sheet of material.

10. The pill crusher pouch according to claim 7, wherein said pouch is dimensioned to be received between a platen and anvil of a pill crusher; and wherein said anvil is integrally fixed to a base and wherein said platen is coupled to said base by moveable handle means having a handle.

11. The pill crusher pouch according to claim 10, further comprising means for moving forcibly said platen against said anvil when said moveable handle means is moved from a first position to a second position, said means for moving including a compression link fixed at a first pivot to said base and at a second pivot to said handle, wherein said second pivot functions as a fulcrum during handle movement.

12. The pill crusher pouch according to claim 7 wherein a least one of said front rectangular panel of sheet material and said back rectangular panel of sheet material includes marking indicia to provide an indication of maximum pill capacity for pill crushing purposes.

13. The pill crusher pouch according to claim 12 wherein a least the other one of said front rectangular panel of sheet material and said back rectangular panel of sheet material includes marking indicia to provide an indication of maximum pill capacity for pill crushing purposes.

* * * * *